United States Patent [19]

Krampe et al.

[11] 4,404,501

[45] Sep. 13, 1983

[54] APPARATUS FOR AUTOMATICALLY SWITCHING OFF AND DISCONNECTING AN ELECTRIC MOTOR SHAFT DRIVE ACCELERATING A WINDING BOBBIN ONCE A CIRCUMFERENTIAL CYLINDER DRIVE HAS BECOME EFFECTIVE

[75] Inventors: Dietrich Krampe, Neunkirchen; Tilo Heyl, Stuttgart, both of Fed. Rep. of Germany

[73] Assignee: Siemens Aktiengesellschaft, Munich, Fed. Rep. of Germany

[21] Appl. No.: 361,355

[22] Filed: Mar. 24, 1982

[30] Foreign Application Priority Data

Mar. 26, 1981 [DE] Fed. Rep. of Germany ..... 3111990

[51] Int. Cl.[3] ..... B65H 54/02

[52] U.S. Cl. ..... 318/7; 242/45; 242/18 R; 242/18 DD

[58] Field of Search ..... 318/3-7, 318/101-103; 242/45, 18 R, 18 DD

[56] References Cited

U.S. PATENT DOCUMENTS

| | | | |
|---|---|---|---|
| 3,536,272 | 10/1970 | Ueyama | 242/45 |
| 3,917,182 | 11/1975 | Lenk | 242/18 R |
| 3,973,739 | 8/1976 | Nilgens et al. | 242/18 R |
| 4,025,830 | 5/1977 | Delaporte | 318/6 |
| 4,043,517 | 8/1977 | Jährig | 242/18 R |
| 4,069,985 | 1/1978 | Lohest et al. | 242/45 |
| 4,125,881 | 11/1978 | Eige et al. | 318/7 |
| 4,146,824 | 3/1979 | Flint et al. | 318/7 |

*Primary Examiner*—J. V. Truhe
*Assistant Examiner*—A. Evans
*Attorney, Agent, or Firm*—Kenyon & Kenyon

[57] ABSTRACT

A circuit for automatically disconnecting a shaft drive spinning a textile winding bobbin and automatically substituting a circumferential cylinder drive for the shaft drive is disclosed. The cylinder drive becomes effective a short time after the start of the textile winding process. A signal proportional to the torque of the shaft drive motor is stored in a storage amplifier shortly after the start of the winding process. If the continuously measured instantaneous current value of the shaft drive exceeds, when both drives operate in parallel, the stored current value, a command to switch off the shaft drive is given.

10 Claims, 2 Drawing Figures

APPARATUS FOR AUTOMATICALLY SWITCHING OFF AND DISCONNECTING AN ELECTRIC MOTOR SHAFT DRIVE ACCELERATING A WINDING BOBBIN ONCE A CIRCUMFERENTIAL CYLINDER DRIVE HAS BECOME EFFECTIVE

BACKGROUND OF THE INVENTION

The present invention relates to textile winding bobbin driving systems, and more particularly, to an apparatus for automatically switching off and disconnecting an electric motor shaft drive which accelerates a winding bobbin and automatically substituting for the shaft drive a synchronized circumferential cylinder drive which engages the winding bobbin as the diameter of the bobbin increases with textiles spun thereon.

Circumferential drives with driving cylinders are very frequently used for spinning the winding bobbins in the chemical fiber industry, since constant thread withdrawal velocities can be maintained relatively easily thereby. These circumferential drives are not always capable of accelerating the empty winding bobbin from standstill to the nominal speed in a relatively short time, however. Therefore, additional shaft drives are utilized which are disconnected once the circumferential cylinder drive has become effective. The change in the torque supplied by the shaft-drive motor due to the activation of the circumferential cylinder drive motor can then be used as a measure of the time at which the shaft drive should be disconnected and turned off. The problem arises, however, that the torque corresponding to the time when the shaft drive motor should be disconnected depends on numerous parameters such as the number of threads to be wound simultaneously, the thread thickness, the thread velocity and the air gap between the bobbin and the driving cylinder.

Accordingly, it is an object of the present invention to provide an apparatus which will automatically disconnect the shaft drive at the proper time dependent on the numerous parameters which affect torque requirements.

SUMMARY OF THE INVENTION

According to the present invention, this problem is solved by the provision that after the acceleration of the bobbin by the shaft drive, and after winding of fibers around the bobbin has begun, but before the circumferential cylinder drive has become effective by engaging the bobbin, a value proportional to the torque supplied by the shaft drive motor can be stored and the signal to disconnect the shaft drive outputted if the measured instantaneous value of the torque of the shaft drive motor after the cylinder drive has become effective exceeds the stored value by a predetermined amount. In other words, the signal proportional to torque stored after deposition of the thread on the bobbin but before engagement of the cylinder drive is the desired value at which the shaft drive motor will be disconnected and switched off after engagement of the cylinder drive when both drives are operating in parallel. This value takes into account all of the prevailing conditions.

Synchronous motors fed by frequency converters are generally used as shaft drives. The frequency converter may consist of, for example, a group of rectifiers which change the A.C. line voltage to D.C. connected to a D.C. to A.C. inverter by an intermediate D.C. link. As substitutes for the direct measurement of torque, signals proportional to torque such as the active current in the d-c link circuit of the converter or, for cost reasons, the reactive current at the output of the frequency converter can be measured, by for example, a suitable current transformer or voltage dropping resistor.

To exclude the dynamic torque changes occurring shortly after the deposition of the threads has begun from being stored as the desired torque value, the signal to store is advantageously given a short time after the winding process has begun.

So that the shaft drive motor is not prematurely switched off, for instance, due to relatively different circumferential velocities between the driving cylinder and the winding bobbin, the conditions precedent to switching-off the shaft drive are advantageously checked for their presence only after a predetermined time by appropriately designed circuitry.

The circuit arrangement, according to the invention, can be realized particularly simply by the provision that a signal proportional to the actual current value prevailing after the thread is deposited on the winding bobbin is transferred into a storage amplifier such as a sample and hold circuit, the output signal of which is compared with the instantaneous value of the current by a comparator which in turn generates the command to switch off the shaft drive if the measured value agrees with the stored value. Advantageously, the signal will be generated if the instantaneous value exceeds the stored value by a certain predetermined amount.

Additional objects and features of the invention will appear from the following description in which the preferred embodiments have been set forth in detail in connection with the accompanying drawings.

DETAILED DESCRIPTION

Figure 1:
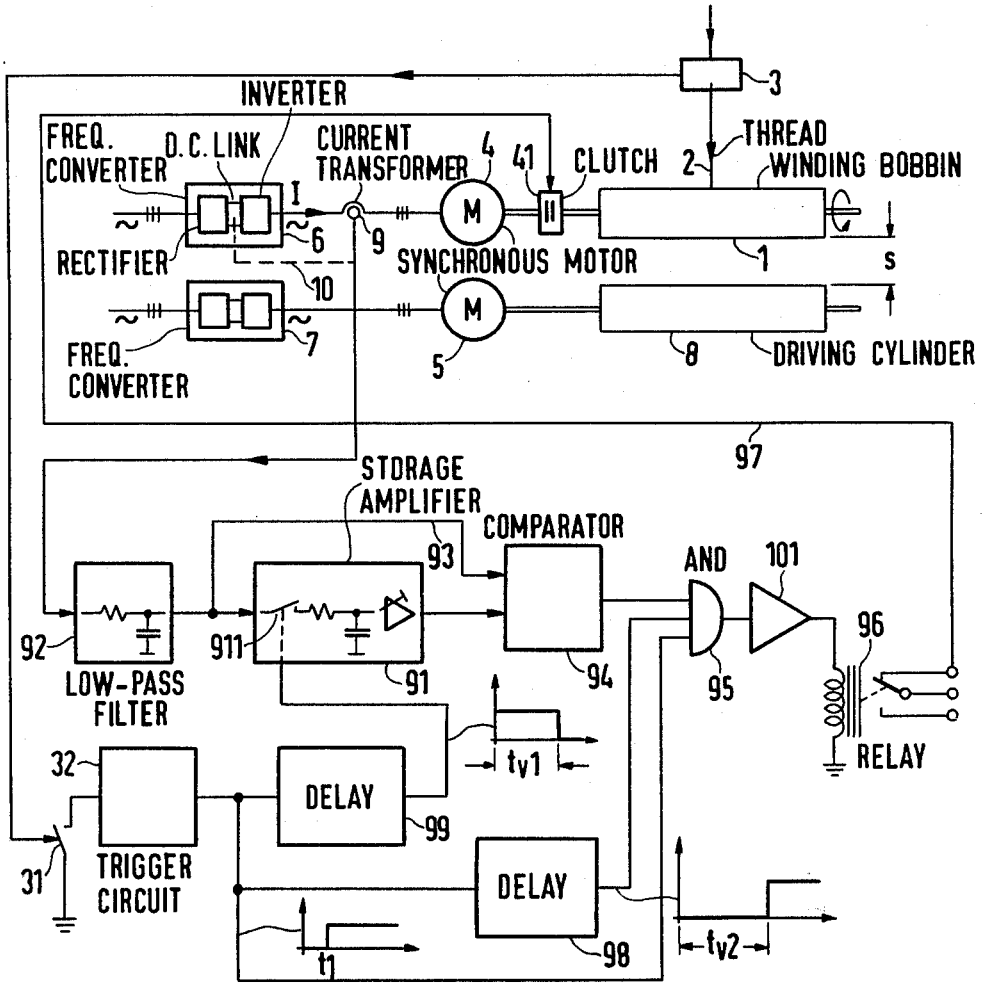
FIG. 1 is a block diagram of the circuit arrangement.
Figure 2:
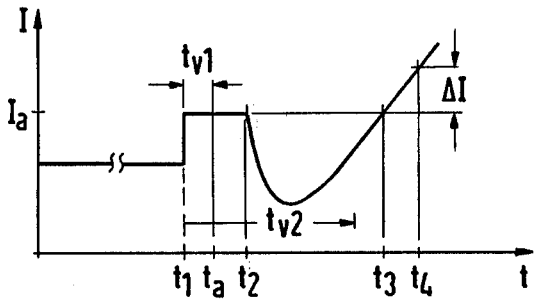
FIG. 2 is a graph of the current drawn by the shaft drive motor.

With reference to FIG. 1, a synchronous motor 4 drawing current from a frequency converter 6 with an intermediate d-c link drives a winding bobbin 1 via a controlled clutch 41. By increasing the frequency and voltage output of the converter 6, the bobbin is thereby accelerated to the nominal velocity, which may correspond, for instance, to a circumferential velocity of 4000 meters per minute. If the motor has reached the desired speed, the thread 2 to be wound, which is drawn, for instance from an extruder not shown, is deposited on the winding bobbin 1 at the time $t_1$, as shown in FIG. 2, by a thread-depositing device 3. The motor current I which is proportional to the torque of the motor 4 thereby increases after short-time dynamic transients have decayed, to the steady-stage value $I_a$.

A signal proportional to this value is fed via a low-pass filter 92 to a storage amplifier 91 such as a sample and hold circuit. The current value may be measured at the converter output by a suitable current transformer 9, as shown, or in the intermediate D.C. link, as shown by the dotted line 10, by a suitable voltage dropping resistor or other method not shown. Simultaneously, the thread depositing device 3 generates a signal which opens the switch 911 after a delay time $t_{v1}$ at the time $t_a$ via the contacts 31 and delay stage 99. The delay stage 99 may consist of a rising edge triggerable monostable multivibrator or single shot outputting a pulse with a pulse width equal to $t_{v1}$ driven by trigger circuit 32. The value proportional to the current drawn by the shaft drive motor prevailing at that instance which is proportional to torque, is thereby stored in the storage amplifier 91.

With the increasing diameter of the winding bobbin due to the fibers wound thereon, the gap s between the circumference of the winding bobbin at the beginning of the winding process and the driving cylinder 8 of the cylinder drive driven by motor 5 gradually decreases. The circumferential drive motor 5 is likewise a synchronous motor which is fed from the frequency converter 7. If the gap s disappears at the instant $t_2$, peripheral contact occurs between the winding bobbin and the driving cylinder 8. Because the circumferential velocities of the winding bobbin and the driving cylinder are well synchronized, the motor 4 is first relieved by the motor 5, so that the measured current I drawn by the motor 4 is reduced according to FIG. 2. With increasing winding diameter, the circumferential velocity of the winding bobbin 1 increases, so that the motor 5 is dragged by the motor 4. The current I of the motor 4 rises again. As indicated in FIG. 2, this current again reaches the stored initial value $I_a$ at the time $t_3$. This value is exceeded at the time $t_4$ by an experimentally determined adjustable value $\Delta I$, at which time the signal to disconnect the shaft drive is generated. This is accomplished by the provision that the output of the storage amplifier 91 and the instantaneous value of the current I of the motor 4 at the output of the filter 92 are compared by comparator 94 which, in case of agreement of both values, delivers a signal. The adjustable value $\Delta I$ can be taken into account by an appropriate design of the comparator 94 or of the storage amplifier 91.

In order that premature signals to switch off the shaft drive are not generated, the output signal of the comparator 94 is fed to AND gate 95 along with the output signal of a delay stage 98 which is triggered when the switch 31 is closed, and the trigger circuit output caused by the closing of the switch 31. The output of AND gate 95 is then fed into a suitable buffer amplifier stage 101 driving a relay 96. Thus, the signal to switch off the motor 4 cannot be given until at least a time $t_{v2}$ after time $t_1$. When all three conditions are met, i.e., the winding process has begun, corresponding to a positive signal at the output of trigger circuit 32, the comparator output corresponds to agreement of the compared currents and time $t_{v2}$ has passed, the output of the AND circuit will go positive, picking relay 96 and delivering the signal via line 97 to the frequency converter 6 to switch off the motor 4 and to the clutch 41 to mechanically separate the winding bobbin from the driving shaft.

What is claimed is:

1. In a textile winding bobbin driving system which includes a first electric motor turning a shaft drive connected to a winding bobbin, a second electric motor driving a circumferential cylinder drive which engages said winding bobbin after textile has been wound thereon to a certain thickness and which is synchronized with the circumferential velocity of said bobbin, means for accepting a signal to switch-off the first motor and disconnect said shaft drive and means for producing a signal corresponding to the start of the winding of textile on said bobbin, an apparatus for automatically producing the signal to switch-off said first motor and disconnect said shaft drive after said circumferential drive has engaged said bobbin comprising:

(a) means for developing a signal proportional to the torque developed by the first motor;

(b) means for storing a value proportional to the torque developed by said first motor after textile has begun to wind on the bobbin but before the cylinder drive has engaged said bobbin and responsive to the means for producing, having an input coupled to said means for developing; and (c) means for generating a signal which can be provided as an output to the means for accepting to switch-off said first motor and disconnect said shaft drive if said signal proportional to the torque of said first motor is greater than said stored value by a predetermined incremental value $\Delta I$, having an input coupled to said means for developing and another input coupled to the output of said means for storing.

2. The apparatus according to claim 1 wherein the first and second motors comprise synchronous motors each drawing current from the output of a frequency converter with an intermediate D.C. link.

3. The apparatus according to claim 2 wherein said means for developing comprise means for measuring the current in said D.C. link.

4. The apparatus according to claim 2 wherein said means for developing comprise means for measuring the current in the output of said frequency converter.

5. The apparatus according to claim 1 wherein said means for storing comprise a storage amplifier having an input coupled to said means for developing, a control input and an output coupled to said means for generating, and further including a first means for delaying the time at which said storage amplifier will no longer be responsive to changes in said signal proportional to the torque of said first motor, having an input coupled to said means for producing and an output coupled to said control input whereby said storage amplifier will store a fixed value proportional to the torque of said first motor after an adjustable delay time $t_{v1}$ after a signal appears on the input of said first means for delaying.

6. The apparatus according to claim 5 wherein said means for generating comprise a comparator having two inputs and an output adapted to be coupled to said means for accepting, said first input coupled to said means for developing, said second input coupled to said output of said storage amplifier, and further including means for preventing said output adapted to be coupled at said means for accepting from prematurely switching off said first motor and disconnecting said shaft drive for a predetermined time $t_{v2}$, having an input coupled to said means for producing.

7. The apparatus according to claim 6 wherein said means for preventing comprise:

(a) a logic circuit which performs the logical AND operation, having first, second and third inputs, the output of which is adapted to be coupled to said means for accepting, said first input coupled to the output of said comparator, and said second input coupled to said means for producing; and (b) a second means for delaying for the predetermined time $t_{v2}$, having an input coupled to said means for producing and an output coupled as the third input to said logic circuit to thereby delay the time at which said signal provided to said means for accepting will be produced.

8. In a textile winding bobbin driving system which includes a first electric motor turning a shaft drive connected to a winding bobbin, a second electric motor driving a circumferential cylinder drive which engages said winding bobbin after textile has been wound thereon to a certain thickness and which is synchronized with the circumferential velocity of said bobbin, means for accepting a signal to switch-off the first motor and disconnect said shaft drive and means for producing a signal corresponding to the start of the winding of textile on said bobbin, a method for automatically producing the signal to switch-off said first motor and disconnect said shaft drive after said circumferential drive has engaged said bobbin comprising:

(a) developing a signal proportional to the torque developed by the first motor;

(b) storing a value proportional to the torque developed by the first motor in response to the means for producing after textile has begun to wind on the bobbin but before the cylinder drive has engaged said bobbin; and (c) generating a signal which can be provided as an output to the means for accepting to switch-off said first motor and disconnect said shaft drive if said signal proportional to the torque of said first motor is greater than said stored value by a predetermined incremental value $\Delta I$.

9. The method according to claim 8 wherein said step of storing comprises delaying the time at which said storing occurs for a predetermined time $t_{v1}$.

10. The method according to claim 8 wherein said step of generating comprises delaying the time at which said signal will be generated for a predetermined time $t_{v2}$.

* * * * *